US005837893A

United States Patent [19]

Chu

[11] Patent Number: 5,837,893

[45] Date of Patent: Nov. 17, 1998

[54] METHOD FOR DETECTING PRESSURE MEASUREMENT DISCONTINUITIES CAUSED BY FLUID BOUNDARY CHANGES

[75] Inventor: Wei-Chun Chu, Littleton, Colo.

[73] Assignee: Marathon Oil Company, Findlay, Ohio

[21] Appl. No.: 275,214

[22] Filed: Jul. 14, 1994

[51] Int. Cl.[6] ..... E21B 47/06

[52] U.S. Cl. ..... 73/152.52; 73/438

[58] Field of Search ..... 73/151, 152, 155, 73/64.55, 433, 438; 166/64, 250

[56] References Cited

U.S. PATENT DOCUMENTS

| | | | |
|---|---|---|---|
| 3,184,965 | 5/1965 | Noik | 73/152 |
| 3,304,776 | 2/1967 | Bennett et al. | 73/151 |
| 3,318,145 | 5/1967 | Lynn et al. | 73/152 |
| 3,455,157 | 7/1969 | Lahaye et al. | 73/151 |
| 3,616,688 | 11/1971 | Roussin et al. | 73/151 |
| 3,990,304 | 11/1976 | Roesner | 73/151 |
| 4,267,726 | 5/1981 | Noik | 73/151 |
| 4,455,875 | 6/1984 | Guimard et al. | 73/708 |
| 4,596,139 | 6/1986 | Gournay | 73/151 |
| 4,790,378 | 12/1988 | Montgomery et al. | 166/66 |
| 4,860,580 | 8/1989 | DuRocher | 73/155 |

OTHER PUBLICATIONS

Gunter, J.M. et al., "Improved Use of Wireline Testers for Reservoir Evaluation", *Journal of Petroleum Technology,* Jun. 1987, pp. 635–644.

Cliff, W.J. et al., "Use of Pressure Gauge Differentials in Well Test Quality Control & Well Performance Evaluation", *Society of Petroleum Engineers,* May 25, 1992.

Murtha, J.A. et al., "Practical Problems in Well Testing Devonian Shale Gas Wells", *Society of Petroleum Engineers,* Oct. 24, 1989.

Mattar, L., "Critical Evaluation and Processing of Data Prior to Pressure Tansient Analysis", *Society of Petroleum Engineers,* Oct. 4, 1992, SPE 24724.

*Primary Examiner*—Michael Brock
*Attorney, Agent, or Firm*—Jack L. Hummel; Jack E. Ebel

[57] ABSTRACT

A pressure data validation method which measures differential pressure along with measuring the absolute pressure while testing a well. The method uses a differential pressure gauge having a known distance between the two differential pressure measuring gauges, wherein the pressure differential indicates fluid density. During the test, as each absolute pressure reading is taken, a differential pressure reading is also taken and this reading is used to determine the density of the fluid surrounding the gauge at the time of the measurement. Each measurement is compared to previous measurements, and a change in fluid density, and thus a change in the type of fluid, is displayed to indicate that any discontinuity in the pressure display is due to a fluid boundary.

8 Claims, 6 Drawing Sheets

METHOD FOR DETECTING PRESSURE MEASUREMENT DISCONTINUITIES CAUSED BY FLUID BOUNDARY CHANGES

TECHNICAL FIELD

This invention relates generally to well testing, and in particular to an apparatus and methods for detecting a type of fluid surrounding a measurement instrument during testing of a well.

BACKGROUND OF INVENTION

There are a number of wire line formation testing devices available in the oil and gas industry. In use, such devices are suspended on a wire line from the Earth's surface and are lowered down into a wellbore. These testing devices are used to gather information about the fluids in the sub-surface formations surrounding a wellbore, and also used to gather information about the condition of the formation.

The operation of current formation testing devices is discussed in such articles as "Improved use of Wire Line Testers for Reservoir Evaluation", by Gunter and Moore, *Journal of Petroleum Technology,* June 1987. This article describes a technique by which a formation tester can be used to determine the density of fluids in an Earth formation where the Earth formation is fluid continuous over a given depth interval. A formation tester is used to measure fluid pressures at a number of depths within the interval. Pressure versus depth data is plotted and the slope of the resulting curve defines a fluid pressure-depth gradient. The value of the gradient is used to determine the fluid density.

One such formation testing device is described in U.S. Pat. No. 4,860,580 issued Aug. 28, 1989 to DuRocher, and entitled "Formation Testing Apparatus and Method". Another such device, which uses differential pressure, is described in U.S. Pat. No. 3,990,304 issued Nov. 9, 1976 to Roesner, entitled "Fluid Interface Measuring Device for use in Earth Bore Holes".

The prior art testing devices and methods presume that the measured pressures are valid indicators of formation conditions. However, the Gunter and Moore article, as well as other prior art articles and patents, describe fluid segregation problems as complicating factors in evaluating well test data.

One type of test, for example, occurs when a pressure measurement device is placed in a well, and the well is shut-in while pressure change is measured. Pressure change discontinuities shown on a graphical display of pressure can be the result of formation discontinuities.

Other conditions can cause pressure discontinuities, however, such as fluid segregation problems where fluid levels change within the well during the test, wherein a fluid boundary passes over the measurement instrument. For example, if the fluid level is dropping and the fluid boundary between oil and water, or oil and gas, passes the measurement instrument, a discontinuity will show on the pressure being measured by the instrument. This discontinuity, of course, does not indicate a formation discontinuity, instead, it simply indicates the changing fluid level. When viewing the pressure data, however, one must know of the changing levels in order to correctly interpret the discontinuity on the graph. Therefore, if the data is not validated in some way, incorrect results are indicated.

The test data can be validated by placing a density measurement instrument into the well along with the pressure measurement instrument, and displaying the density information in addition to the pressure information. This is costly, however, since a density measurement instrument requires a multi-conductor cable connection to the surface.

There is need in the art then for a method of validating test data from a well. There is further need in the art for determining when discontinuities in test data are the result of fluid segregation. There is a further need for such a method that does not require a separate density measurement instrument to be placed in the well during pressure testing. The present invention meets these and other needs in the art.

DISCLOSURE OF INVENTION

It is an aspect of the present invention to provide a method for determining a type of fluid surrounding a measurement instrument in a well.

It is another aspect of the invention to evaluate a difference in pressure measured by a differential pressure measurement instrument in order to determine density of a fluid.

Still another aspect is to evaluate a change in density to determine a fluid boundary.

A still further aspect is to plot the fluid boundaries along with pressure during testing of a well, thereby showing where pressure change discontinuities are the result of fluid boundaries.

The above and other aspects of the invention are accomplished in a method which measures differential pressure along with measuring the absolute pressure while testing a well. The method uses a differential pressure gauge having a known distance between the two ports of a differential pressure measuring gauge, wherein the pressure differential indicates fluid density.

During the test, as each absolute pressure reading is taken, a differential pressure reading is also taken and this reading is used to determine the density of the fluid surrounding the gauge at the time of the measurement. Each measurement is compared to previous measurements, so that a change in fluid density, and thus a change in the type of fluid, can be determined. If a change in fluid density occurs, this often causes a discontinuity in the absolute pressure reading taken during the fluid change.

The method graphically displays the absolute pressure reading with respect to time, as well as the differential pressure with respect to time. This indicates each change in differential pressure, thus validating any discontinuity that may occur in the absolute pressure at the same time.

DESCRIPTION OF THE DRAWINGS

The above and other aspects, features, and advantages of the invention will be better understood by reading the following more particular description of the invention, presented in conjunction with the following drawings, wherein.

BEST MODE FOR CARRYING OUT THE INVENTION

The following description is of the best presently contemplated mode of carrying out the present invention. This description is not to be taken in a limiting sense but is made merely for the purpose of describing the general principles of the invention. The scope of the invention should be determined by referencing the appended claims.

Figure 1:
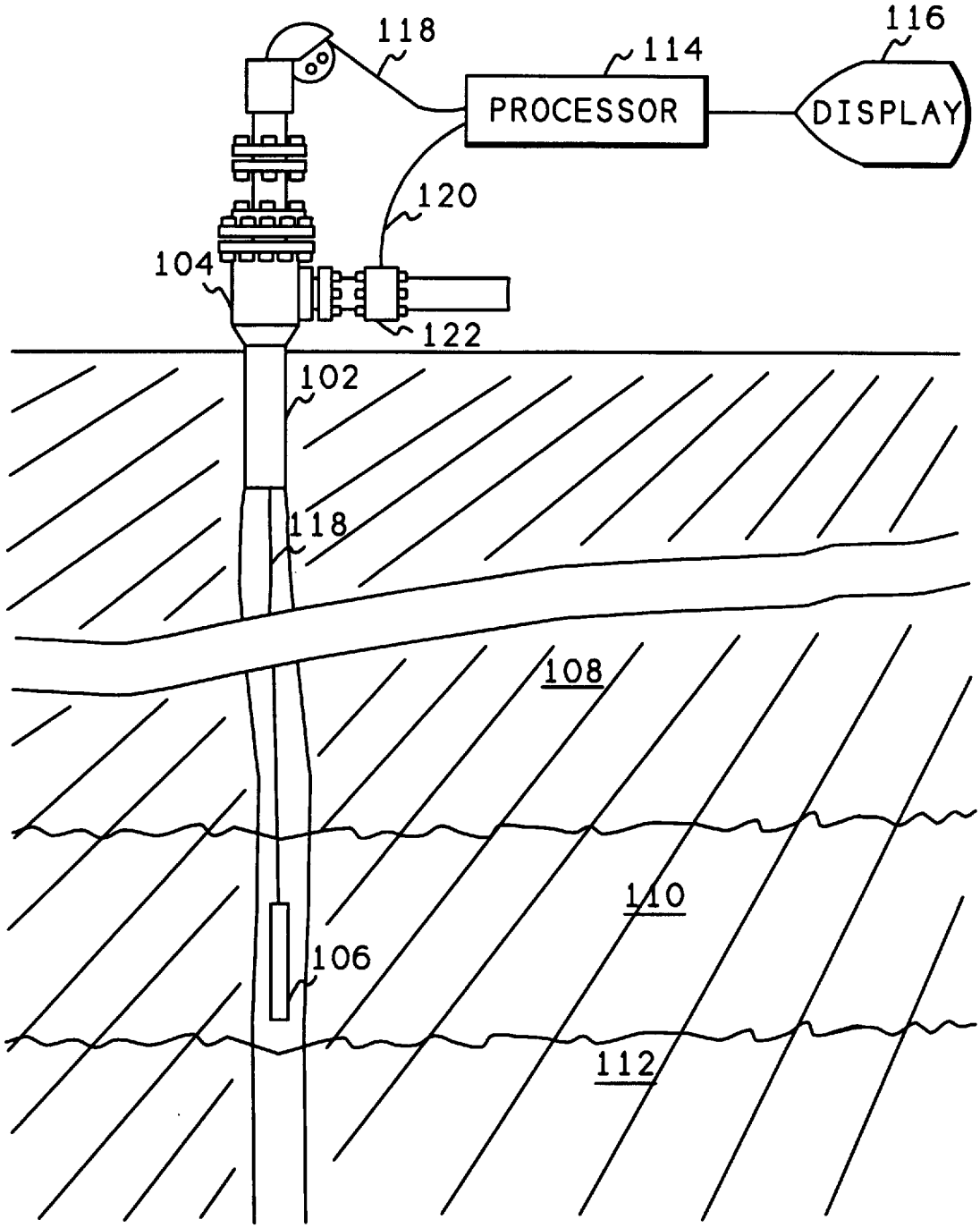
FIG. 1 is a schematic view of a differential pressure gauge in a well during a test and further shows a computer system implementing the method of the present invention.

FIG. 1 shows a schematic view of the method of the present invention, including a differential pressure gauge in a well, and a computer system containing the software of the present invention. Referring now to FIG. 1, a wellbore 102 is shown having a wellhead 104. A wire line 118 passes through the wellhead 104 and down into the well 102 to raise or lower a test device 106. The test device 106 contains both an absolute pressure gauge and a differential pressure gauge. One embodiment of the test device 106 is shown below with respect to FIG. 6.

Three different fluids are shown within the formation containing the well 102. A fluid 108, which typically might be a gas, is shown above a fluid 110, which typically might be oil. The gauge 106 is contained within the fluid 110. Below the fluid 110 is another fluid 112 which typically might be water. If, during the test, fluid 112 rise above the gauge 106, a discontinuity might be indicated in the absolute pressure being measured by the gauge 106 as the fluid boundary between fluid 110 and fluid 112 pass over the gauge 106. A similar situation would occur should the fluid 110 drop below the gauge 106 such that the gauge would then be surrounded by fluid 108. Should either one of these conditions occur, the pressure reading from the absolute pressure gauge within the device 106 might show a discontinuity that could be misinterpreted as a discontinuity within the formation. If it can be determined, however, that the type of fluid surrounding the gauge 106 has changed, the fluid change can explain the discontinuity in the absolute pressure. That is, if the absolute pressure reading can be validated, additional information can be obtained about the formation. The method of the present invention, as shown in FIG. 1 and more fully described below, provides a way of validating the fluid level change within the formation.

A processor 114 controls the testing by lowering the wire line 118 to a predetermined location in the well, typically within a producing interval of the formation. The processor 114 then sends a signal to the gauge 106 to cause it to take a pressure measurement, and the processor receives the pressure readings from the device 106 through the wire line 118. In addition, the processor 114 may activate a valve 122 through a signal 120 to cause the well to either shut-in or flow at various times during the test. The test data received from the device 106, and the data created by the analysis method of the present invention, can be displayed by the processor on a display device 116 such as a plotter device or a CRT device.

Figure 2:
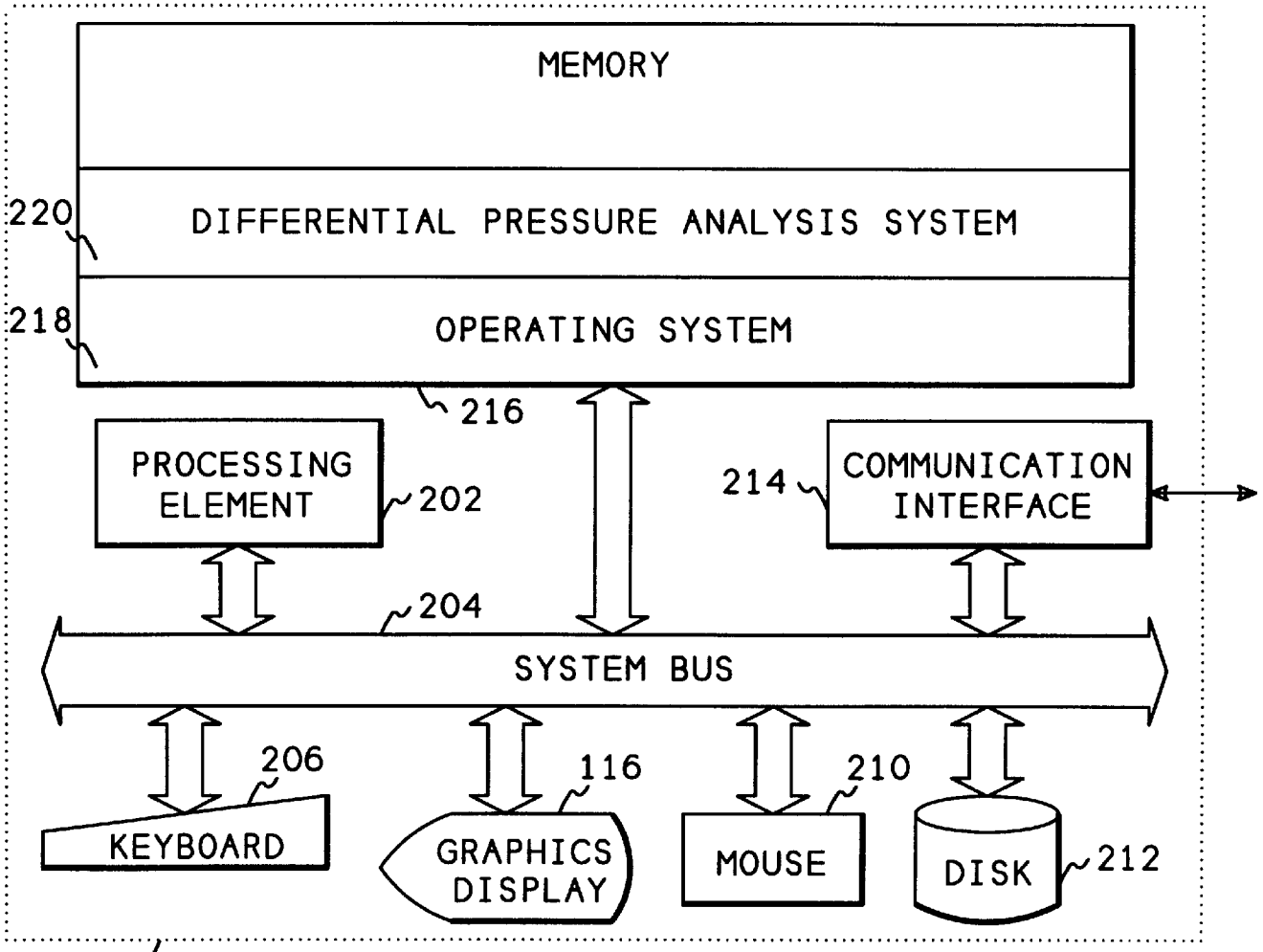
FIG. 2 shows a block diagram of the computer system of FIG. 1, including the software that implements the method of the present invention

FIG. 2 shows a block diagram of the computer system 114 of FIG. 1. Referring now to FIG. 2, the processor 114 is shown having a processing element 202 which communicates to other elements of the computer system 114 over a system bus 204. A keyboard 206 and a mouse device 210 allow the user of the computer system 114 to input data. A graphics display 116, as described above with respect to FIG. 1, allows the computer system 114 to output graphical information to the user of the system. A disk 212 stores the software of the present invention, as well as data created during testing. A communications interface 214 allows the computer system 114 to send information and receive information over the wire line 118, as well as send the signal 120 to the valve 122.

A memory 216 of the processor 114 contains an operating system, which typically could be either the DOS, or Unix operating systems, as well as the differential pressure analysis system 220 of the present invention.

Figure 3:
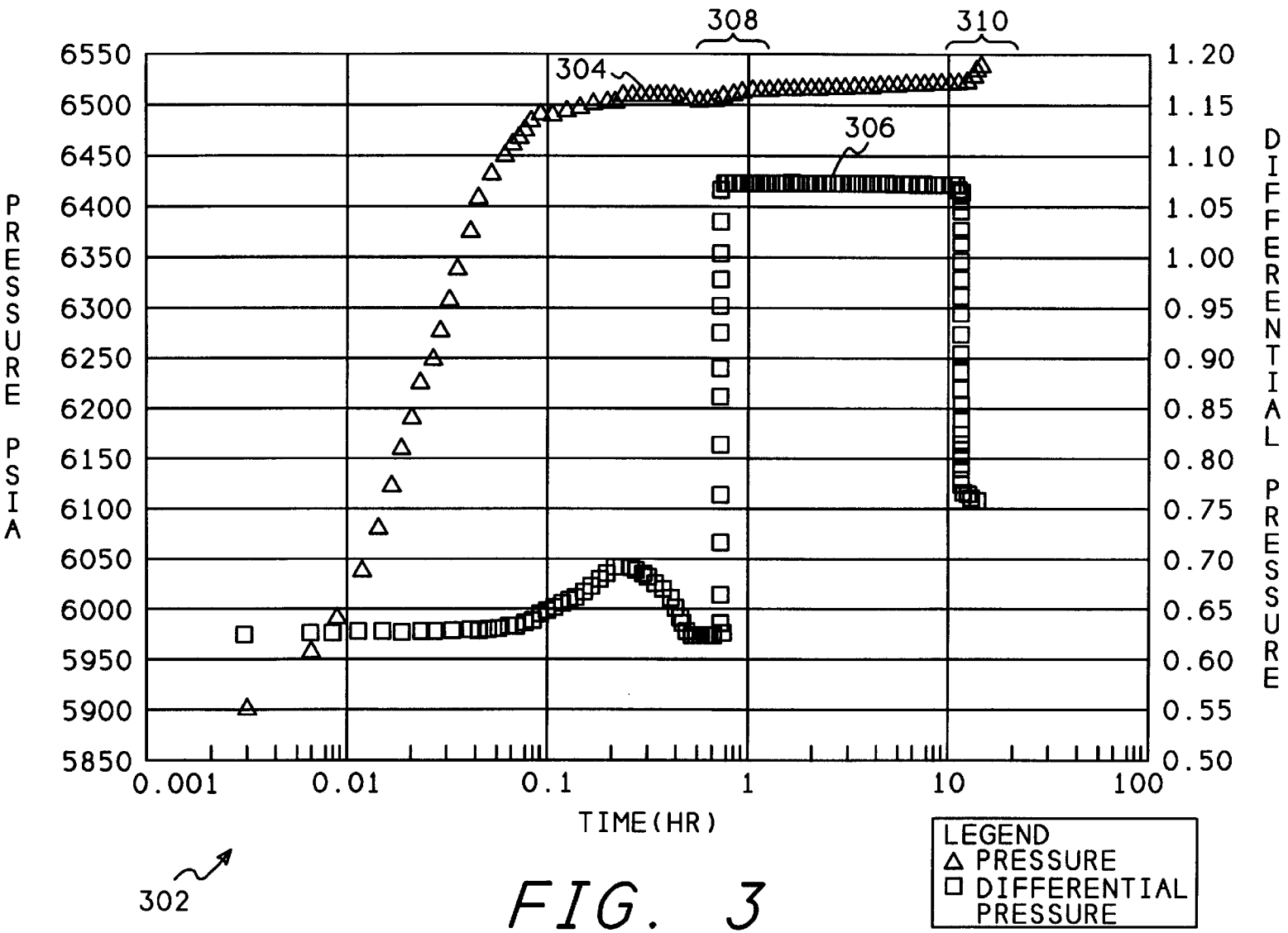
FIG. 3 shows a chart of fluid pressure and fluid differential pressure during testing of a well.

FIG. 3 shows a chart of fluid pressure and fluid differential pressure during a typical test of a well, as measured by the present invention. Referring now to FIG. 3, the chart 302 shows an absolute pressure measurement 304 as indicated by triangle symbols. The legend on the left side of the chart 302 indicates the actual absolute pressure measurement values. Differential pressure is shown by the square symbols 306 and the values for differential pressure is shown on the right side of the chart 302. The scale along the bottom of the chart represents time, displayed in logarithmic form.

The area 308 of the chart indicates that the type of fluid surrounding the gauge changed abruptly at the same time a discontinuity is shown in the absolute pressure. The differential pressure values on the right side of the chart 302 indicate that this was a change from oil to water. That is, during the time of just before one hour to just after ten hours, the measurement device was surrounded by water. The area 310 of the chart indicates that just after ten hours, the fluid level in the well being tested changed again such that the test device went from water to another fluid, thus in the area 310 the discontinuity within the absolute pressure 304 was explained by the change in the differential pressure 306.

Figure 4:
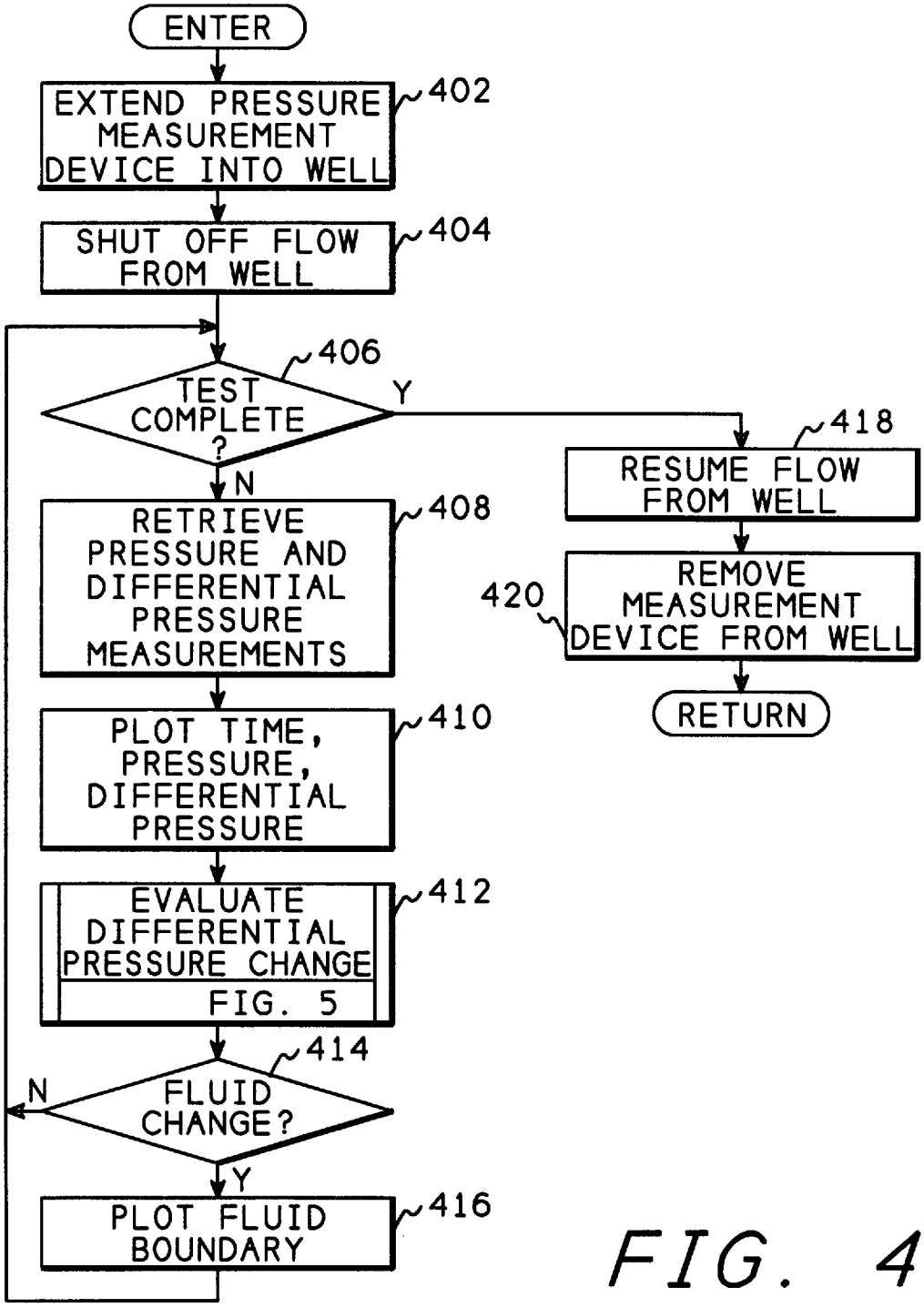
FIGS. 4 and 5 show a flowchart of the method of the present invention that creates the chart of FIG. 3.
Figure 5:
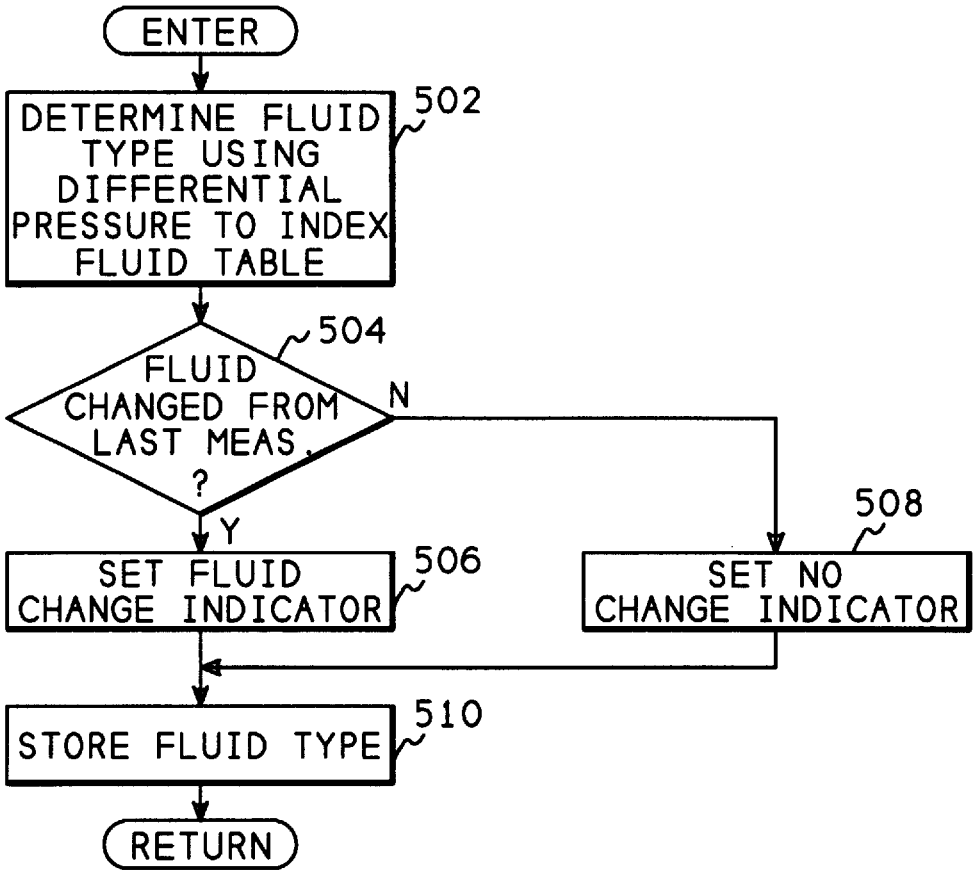

FIGS. 4 and 5 show a flowchart of the process of the present invention, which is contained within the processor 114 of FIG. 1. Referring now to FIG. 4, when a test is to be performed, the operating system 218 (FIG. 2) calls the method of FIG. 4, and control enters at block 402. Block 402 extends the measurement device 106 into the well through wire line 118. Block 404 then shuts off flow from the well (called shutting-in the well) and block 406 determines whether the testing has gone on long enough to be complete. Initially, of course, the test will not be complete so block 406 goes to block 408 which sends a signal to the measurement device 106 to cause a measurement to be taken, and then it retrieves absolute and differential pressure measurements from the measurement device 106. Block 410 then plots these measurements, as shown above with respect to FIG. 3. Block 412 calls FIG. 5 to evaluate the differential pressure measurement against previous measurements to determine whether the fluid surrounding the gauge 106 has changed. Block 414 then determines whether a fluid change has occurred, and if not, transfers back to block 406 to complete the test or take the next measurement.

If the fluid has changed, block 414 goes to block 416 which plots a fluid boundary indication on the plot of the absolute and differential pressure gauges. This fluid boundary indication can be used to validate the pressure data, and indicate that a fluid boundary has moved past the pressure gauge 106 during this time of the test. In the graph of FIG. 3, the boundary indication is the vertical line of square symbols at locations 308 and 310. Those skilled in the art will recognize, however, that additional symbols could be plotted at the boundary locations.

After the test is complete, as determined by factors external to the invention, block 406 transfers to block 418 which opens valve 122 through signal 120, to resume flow from the well, and then block 420 removes the measurement device from the well before returning to the operating system.

FIG. 5 shows the method, called from block 412 of FIG. 4, to determine whether a fluid change has occurred between successive measurements. Referring now to FIG. 5, after entry, block 502 determines the fluid type using the differential pressure to index a fluid table. It is well known in the art that different fluid types will have different densities. By using a differential pressure gauge having a known distance between the two ports of the differential pressure measurement device, such as shown below with respect to FIG. 6, the density of the fluids surrounding the gauge can be determined by the differential pressure. For example, Table 1 shows a correlation of differential pressure, measured over a one foot interval, and the type of fluid indicated by the differential pressure. By using the pressure measurement to index the table, the type of fluid surrounding the gauge can be readily determined.

Block 504 determines whether the fluid in the current measurement is different from the fluid determined by the last measurement of the device. If not, block 504 transfers to block 508 which sets an indicator to show that no change has occurred and then block 510 stores the fluid type for this measurement for use when analyzing the next measurement. If the fluid had changed, block 504 transfers to block 506 which sets an indicator showing that the fluid has changed. This indicator will be used by block 414 of FIG. 4 described above. Control then goes to block 510 which stores the fluid type before returning to FIG. 4.

Those skilled in the art will recognize that the differential pressure measurement may need to be compared to several previous measurements in order to determine whether a fluid change has occurred.

Figure 6:
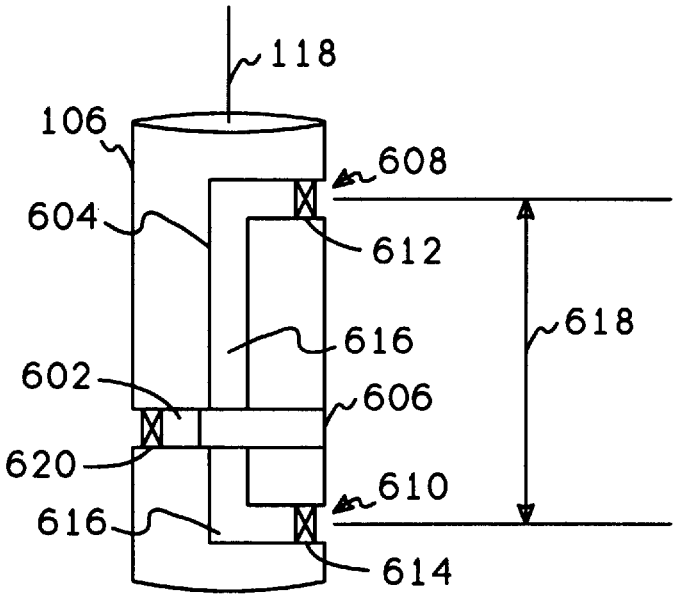
FIG. 6 shows a pressure gauge suitable for use with the present invention.

FIG. 6 shows a block diagram of a pressure gauge suitable for use with the present invention. Other types of gauges, as described above in the background of the invention, might also be used. Referring now to FIG. 6, the gauge 106 is shown connected to the wire line 118. Within the gauge 106, an absolute pressure measuring device 602 is shown separated from the surrounding fluid by a seal 620. A differential pressure gauge 606 is shown connected to two openings 608 and 610 through chambers having fluid 616 contained therein. The chambers are sealed from the surrounding fluid by seals 612 and 614. Line 618 indicates the distance separating the two ports 608 and 610, which for the present invention, might be set at one foot. This distance can be any fixed distance, however, calculation of the density is made easier by making the distance exactly one foot.

Having thus described a presently preferred embodiment of the present invention, it will now be appreciated that the aspects of the invention have been fully achieved, and it will be understood by those skilled in the art that many changes in construction and widely differing embodiments and applications of the invention will suggest themselves without departing from the spirit and scope of the present invention. The disclosures and the description herein are intended to be illustrative and are not in any sense limiting of the invention, more preferably defined in scope by the following claims.

TABLE 1

| Density | Fluid |
|---|---|
| .43 PSI (1.07 GM/CC) | Water |
| .35 PSI (0.65 GM/CC) | Oil |
| .05 PSI (0.09 GM/CC) | Gas |

What is claimed is:

1. A method for validating pressure test data obtained from a well, said method comprising the steps of:

(a) extending a pressure measurement instrument into said well to a predetermined depth in said well, said pressure measurement instrument having a pair of gauges, a first gauge for measuring absolute pressure, and a second gauge for measuring a differential pressure over a predefined differential measurement distance;

(b) periodically sending a signal to said pressure measurement instrument to initiate a measurement of pressure inside said well;

(c) receiving a set of measurements resulting from said signal sent in step (b), said set comprising an absolute pressure measurement from said first gauge and a differential pressure measurement from said second gauge;

(d) for each of said set of measurements obtained in step (c), displaying said absolute pressure measurement on a display device;

(e) for each of said set of measurements obtained in step (c), using said differential pressure to determine a type of fluid surrounding said pressure measurement instrument;

(f) when said type of fluid obtained in step (e) differs from a type of fluid determined from an immediately previous set of measurements, indicating a fluid boundary on said display device; and (g) validating any discontinuities which may occur in said absolute pressure measurements by reference to said fluid boundary.

2. The method of claim 1 wherein step (e) determines said type of fluid comprising accessing a table of fluid types using said differential pressure as an index to retrieve said fluid type.

3. The method of claim 1 wherein said indicating of step (f) comprises displaying each of said differential pressure measurements on said display device, wherein said fluid boundary is displayed as a vertical displacement of said differential pressure measurements.

4. The method of claim 1 wherein said differential measurement distance is one foot.

5. A method for validating pressure test data obtained from a well, said method comprising the steps of:

(a) extending a pressure measurement instrument into said well to a predetermined depth in said well, said pressure measurement instrument having a pair of gauges, a first gauge for measuring absolute pressure, and a second gauge for measuring a differential pressure over a predefined differential measurement distance;

(b) shutting in said well;

(c) periodically sending a signal to said pressure measurement instrument to initiate a measurement of pressure inside said well;

(d) receiving a set of measurements resulting from said signal sent in step (c), said set comprising an absolute pressure measurement from said first gauge and a differential pressure measurement from said second gauge;

(e) for each of said set of measurements obtained in step (d), displaying said absolute pressure measurement on a display device;

(f) for each of said set of measurements obtained in step (d), using said differential pressure to determine a type of fluid surrounding said pressure measurement instrument;

(g) when said type of fluid obtained in step (f) differs from a type of fluid determined from an immediately previous set of measurements, indicating a fluid boundary on said display device; and (h) validating any discontinuities which may occur in said absolute pressure measurements by reference to said fluid boundary.

6. The method of claim 5 wherein step (f) determines said type of fluid comprising accessing a table of fluid types using said differential pressure as an index to retrieve said fluid type.

7. The method of claim 5 wherein said indicating of step (g) comprises displaying each of said differential pressure measurements on said display device, wherein said fluid boundary is displayed as a vertical displacement of said differential pressure measurements.

8. The method of claim 5 wherein said differential measurement distance is one foot.

* * * * *